US008146281B2

(12) United States Patent
Zimmerman

(10) Patent No.: US 8,146,281 B2
(45) Date of Patent: Apr. 3, 2012

(54) AMMUNITION CHAIN FOR TOY PROJECTILES

(75) Inventor: Jeffrey C. Zimmerman, King of Prussia, PA (US)

(73) Assignee: Buzz Bee Toys (H.K.) Co., Limited, Kowloon (HK)

( * ) Notice: Subject to any disclaimer, the term of this patent is extended or adjusted under 35 U.S.C. 154(b) by 469 days.

(21) Appl. No.: 12/011,932

(22) Filed: Jan. 30, 2008

(65) Prior Publication Data

US 2009/0151710 A1 Jun. 18, 2009

(30) Foreign Application Priority Data

Dec. 18, 2007 (HK) ..... 07113785.5

(51) Int. Cl.
*F41A 9/79* (2006.01)

(52) U.S. Cl. ..... 42/54; 124/1; 124/41.1; 124/45; 124/48; 124/50; 124/51.1; 124/52; 124/53; 124/82; 89/33.2; 89/33.5; 89/34; 89/35.01; 89/35.02; 42/49.01; 42/57; 42/87; 42/88; 42/89; 446/473

(58) Field of Classification Search ..... 124/1, 41.1, 124/45, 48, 50, 51.1, 52–53, 82; 89/33.2, 89/33.5, 34, 35.01, 35.02; 42/49.01, 87–89, 42/54, 57; 446/473
See application file for complete search history.

(56) References Cited

U.S. PATENT DOCUMENTS 1,150,435 A * 8/1915 Laird et al. ..... 89/35.01
2,480,972 A * 9/1949 Sanford et al. ..... 89/35.02
3,112,673 A * 12/1963 Sarvis ..... 89/35.01
3,182,556 A * 5/1965 Rocha ..... 89/35.02
3,190,179 A * 6/1965 Benoit ..... 89/35.02
3,253,512 A * 5/1966 Schallehn ..... 89/35.02
3,254,565 A * 6/1966 La Fever et al. ..... 89/35.02
3,304,644 A * 2/1967 Ferri et al. ..... 42/54
3,318,245 A * 5/1967 Ferri et al. ..... 102/281
3,362,097 A * 1/1968 Ferri et al. ..... 42/54
3,377,919 A * 4/1968 Clark ..... 89/35.02
3,465,640 A * 9/1969 Sarvis ..... 89/35.02
4,004,491 A * 1/1977 Seeling ..... 89/35.01
4,011,788 A * 3/1977 Reed ..... 89/33.2
4,050,323 A * 9/1977 I'Anson ..... 198/853
4,290,339 A * 9/1981 Skahill ..... 89/33.25
4,473,365 A * 9/1984 Lapeyre ..... 474/212
4,882,901 A * 11/1989 Lapeyre ..... 59/84
4,885,976 A * 12/1989 Nordmann ..... 89/35.01
5,131,315 A * 7/1992 Maher et al. ..... 89/45
5,251,532 A * 10/1993 Frommelt et al. ..... 89/1.14
5,347,908 A * 9/1994 Mouterde et al. ..... 89/34

(Continued)

FOREIGN PATENT DOCUMENTS

CN 2909161 Y 6/2007

(Continued)

*Primary Examiner* — Gene Kim
*Assistant Examiner* — Alexander R Niconovich
(74) *Attorney, Agent, or Firm* — Volpe and Koenig, P.C.

(57) ABSTRACT

A link for a toy ammunition chain made up of a plurality of links hinged together side-by-side in articulated fashion includes a cylindrical body adapted to receive a soft projectile. A first hinge component extends laterally from the body and has a pair of hinge pins. A second hinge component extends laterally from the body at a position opposite the first hinge component and has a pair of recesses each for pivotally receiving a hinge pin of an adjacent link in the chain.

5 Claims, 4 Drawing Sheets

U.S. PATENT DOCUMENTS

| | | | | |
|---|---|---|---|---|
| 5,368,526 | A * | 11/1994 | Hynes | 474/207 |
| 5,398,590 | A * | 3/1995 | Snyder, Sr. | 89/33.16 |
| 5,492,065 | A * | 2/1996 | Jena et al. | 102/531 |
| 5,546,845 | A * | 8/1996 | Wossner et al. | 89/35.01 |
| 5,660,159 | A * | 8/1997 | Clayton | 124/66 |
| 5,719,348 | A * | 2/1998 | Bill et al. | 86/38 |
| 6,430,861 | B1 * | 8/2002 | Ayers et al. | 42/84 |
| 6,799,500 | B1 * | 10/2004 | Kulikowski | 89/34 |
| 7,168,560 | B2 * | 1/2007 | Finetti et al. | 206/390 |
| 7,406,907 | B1 * | 8/2008 | Goon et al. | 89/34 |
| 7,406,908 | B1 * | 8/2008 | Goon et al. | 89/35.01 |
| 7,568,421 | B2 * | 8/2009 | Cummings | 89/33.2 |
| 8,061,256 | B1 * | 11/2011 | Kurz et al. | 89/33.2 |
| 2006/0046877 | A1 * | 3/2006 | Gajda, Jr. | 473/572 |
| 2007/0034197 | A1 * | 2/2007 | Tschech | 124/65 |
| 2007/0044363 | A1 * | 3/2007 | McClellan | 42/87 |
| 2008/0022988 | A1 * | 1/2008 | Rosenblum et al. | 124/27 |

FOREIGN PATENT DOCUMENTS

| | | | |
|---|---|---|---|
| CN | 2909162 | Y | 6/2007 |
| CN | 2909163 | Y | 6/2007 |

* cited by examiner

AMMUNITION CHAIN FOR TOY PROJECTILES

BACKGROUND OF THE INVENTION

The present invention relates to an ammunition chain or belt for holding a number of projectiles for toy guns. The invention more particularly, although not exclusively relates to an articulated belt comprising a plurality of projectile-holding links for use with toy guns.

Toy guns are known to comprise a barrel or magazine containing a plurality of projectiles for sequential firing. The number of projectiles that can be loaded into such barrels or magazines is limited by the size of the barrel or magazine and this limits play time between reloading.

It is an object to overcome or substantially ameliorate the above disadvantage and/or more generally to provide a toy "bullet chain" or "ammunition belt" comprising a plurality of articulated links—each adapted to contain a projectile. It is a further object to provide a projectile-holding link for such a chain. It is yet a further object to provide a toy gun having a loading mechanism for advancing such a chain.

SUMMARY

There is disclosed herein a link for a toy ammunition chain made up of a plurality of said links hinged together side-by-side in articulated fashion, the link comprising:

a substantially cylindrical body adapted to receive a soft projectile therein;

a first hinge component extending laterally from the body and comprising a pair of hinge pins; and a second hinge component extending laterally from the body at a position substantially opposite the first hinge component and comprising a pair of recesses each adapted to pivotally receive a hinge pin of an adjacent said link in the chain.

Preferably, the first hinge component is formed as a plastics moulding and wherein the first hinge component comprises a hinge boss moulded integrally with the body and wherein the hinge pins are moulded integrally with the hinge boss.

Preferably, the second hinge component comprises a pair of the hinge lugs mutually spaced apart sufficiently to receive a hinge boss of an adjacent said link in the chain, each hinge lug comprising one of said recesses.

Preferably, at least one of the hinge lugs comprises a cut-out extending from its recess to enable lateral insertion of a hinge pin of an adjacent said link in the chain.

Preferably, the body has open ends and the body comprises a through-passage extending between said open ends, the through-passage being wider at one open end than the other open end.

Preferably, the body contains a soft projectile.

There is further disclosed herein a toy ammunition chain made up of a plurality of the above-disclosed links hinged together side-by-side in articulated fashion.

There is further disclosed herein a combination comprising the above-disclosed toy ammunition chain, and a toy gun comprising an advancing sprocket having teeth shaped to engage with each link of the chain for drawing each link into a firing position.

BRIEF DESCRIPTION OF THE DRAWINGS

A preferred form will now be described by way of example with reference to the accompanying drawings, wherein.

DESCRIPTION OF THE PREFERRED EMBODIMENT

Figure 2:
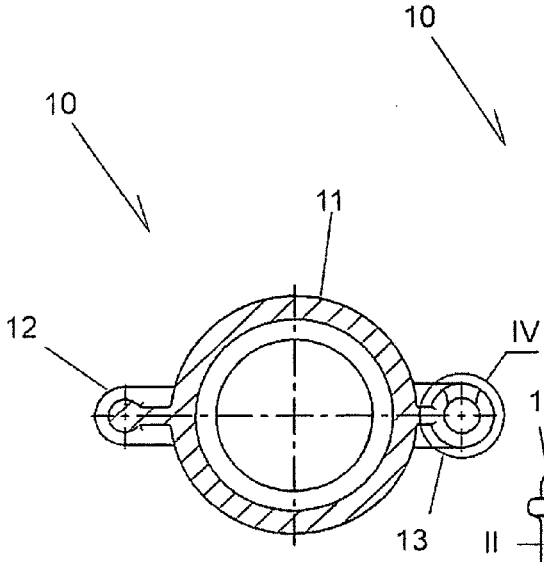
FIG. 2 is a schematic cross-sectional elevation of the link taken at II-II in FIG. 1.
Figure 1:
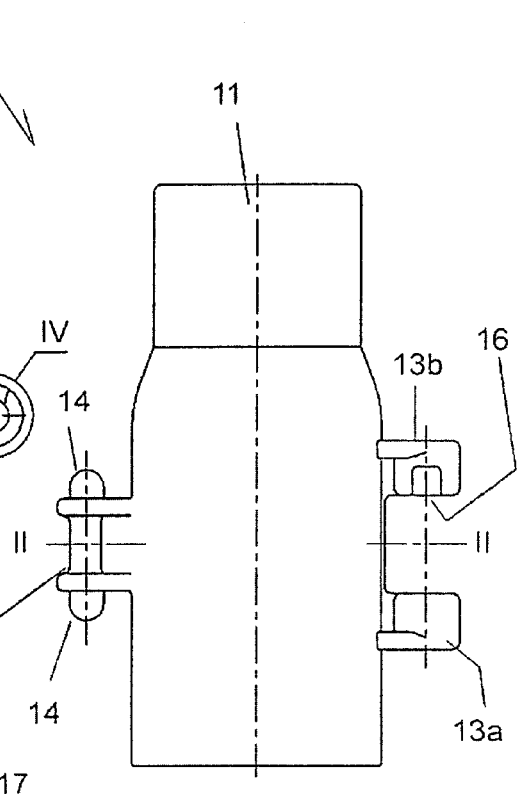
FIG. 1 is a schematic elevation of a projectile-holding link for a toy bullet chain or ammunition belt.
Figure 3:
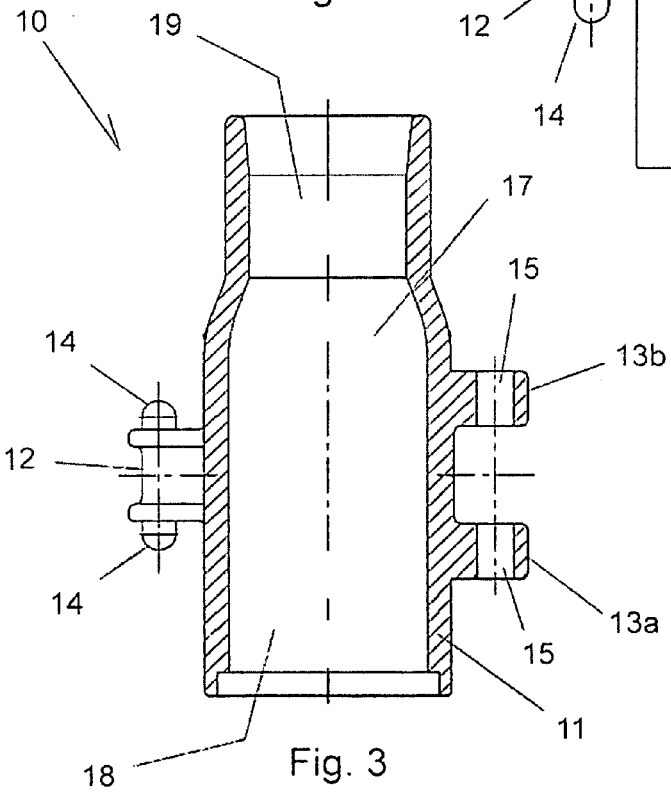
FIG. 3 is a schematic cross-sectional elevation of the link of FIG. 1.
Figure 4:
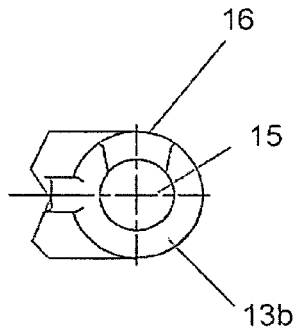
FIG. 4 is a schematic detailed illustration of that part of the link indicated at IV in FIG. 2.

In FIGS. 1 to 4 of the accompanying drawings there is depicted schematically a link 10 for a toy ammunition chain. Such a chain (as depicted in the FIG. 5) would comprise a plurality of links 10 hinged together side-by-side.

Each link 10 is formed of moulded plastics material and comprises a hollow body 11 having a through-passage which is wide at one end 18 and narrow at the other end 19. The through-passage receives a soft projectile which would be fired out of the narrow end of the body 11 by air pressure generated by a pumping action in a toy gun and delivered to the projectile in a manner not specific to the present invention. Alternatively a mechanical firing piston for example might act directly upon the projectile. In an exemplary manner, the soft projectile might be received within the body 11 by parts as depicted in the Assignee's US Patent Application published under number US 2006/0225717—the content of which is incorporated herein by cross-reference and some of which are indicated generally at 36 in FIG. 6 of the present drawings.

At one side of the body 11 there is formed a first hinge component comprising a laterally projecting hinge boss 12 from which a pair of hinge pins 14 extend in the longitudinal direction of the body. Parts 12 and 14 are an integral moulding with the body 11.

Figure 5:
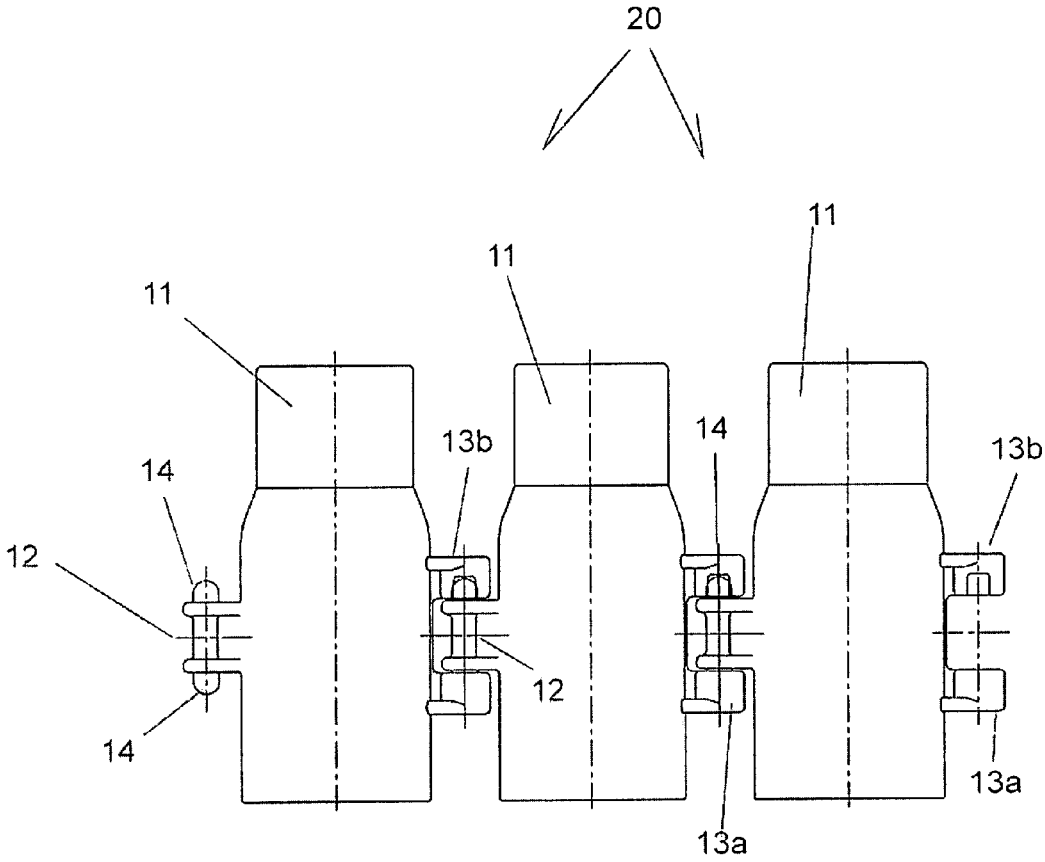
FIG. 5 is a schematic elevation of part of a ammunition chain comprising three links.

At the diametrically opposed side of the body 11, there is provided a second hinge component comprising a pair of spaced apart, laterally projecting hinge lugs 13*a* and 13*b*. These parts are formed as an integral moulding with the body 11. Each hinge lug comprises a recess 15, which in the preferred embodiment each take the form of an open-ended aperture, but might alternatively be blind apertures with the single opening of one blind aperture facing toward the single opening of the other blind aperture. Hinge lug 13*b* includes a cut-out 16 extending laterally from the recess 15. In order to pivotally interconnect a chain of articulated links 10, one pin 14 of one link is inserted into the recess 15 of hinge lug 13*a* of an adjacent link, and then the other pin 14 is snapped through the cut-out 16 into the recess 15 of hinge lug 13*b* of the adjacent link. Such an articulated chain 20 is shown in FIG. 5.

Once the projectile chain is formed, or prior to interconnection of the links of the chain, individual soft projectiles or bullets 34 are loaded into each body 11.

Figure 7:
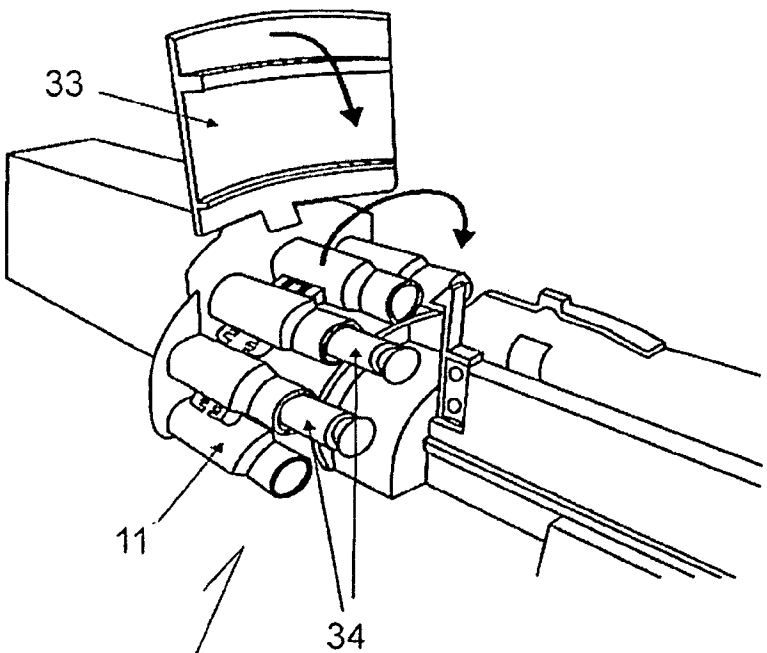
FIG. 7 is a schematic perspective illustration of the same portion of a toy gun shown in FIG. 6 loaded with the ammunition chain of FIG. 5 with each link containing a soft projectile.
Figure 6:
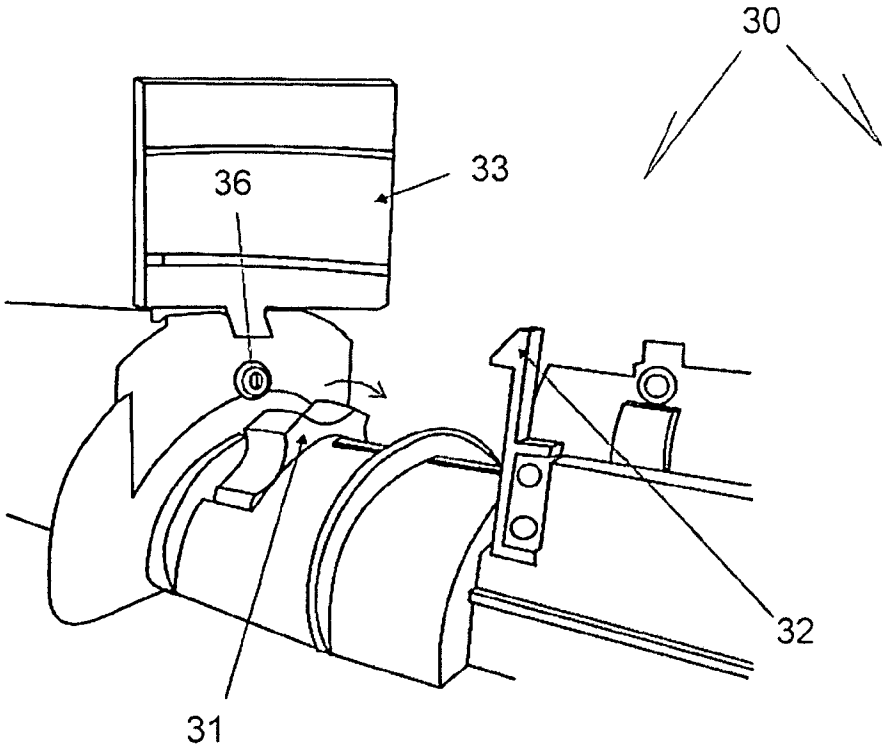
FIG. 6 is a schematic perspective illustration of a portion of a toy gun for loading with the ammunition chain of FIG. 5.
Figure 8:
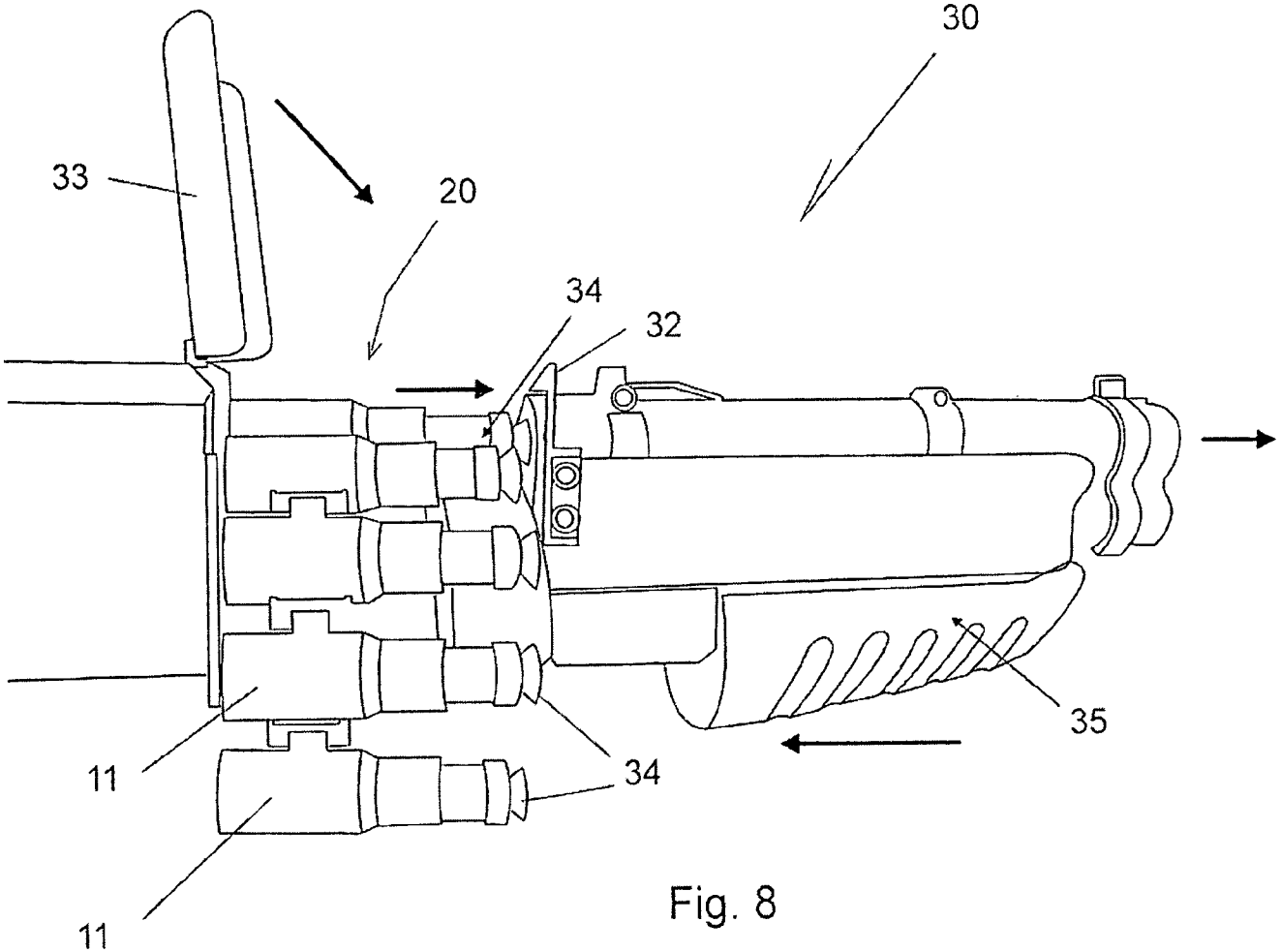
FIG. 8 is a schematic elevation of the same portion of the toy gun shown in FIGS. 6 and 7 loaded with the ammunition chain and soft projectiles.

Parts of a toy gun 30 suitable for use with the projectile chain 20 are shown in FIGS. 6 to 8. Relevant amongst these parts is a drive sprocket 31 which comprises a number of teeth to engage with each link of the projectile-loaded chain 20. The drive sprocket 31 is mechanically advanced one tooth at a time upon pumping action of handle 35 to bring each projectile inline with the firing parts 36 (and also charge an air pressure reservoir within the toy gun for firing the projectiles).

A hinged cover 33 closes over the drive sprocket 31 during play. A catch 32 retains the cover 33 in the closed position. In use, a separate firing trigger (not shown) is depressed to release compressed air from an internal reservoir to fire the soft projectiles from the toy gun.

It should be appreciated that modifications and alterations obvious to those skilled in the art are not to be considered as beyond the scope of the present invention. For example, cutouts 16 could be provided in both of the hinge lugs 13*a* and 13*b* to ease interconnection of the links.

The invention claimed is:

1. A link for a toy ammunition chain made up of a plurality of said links hinged together side-by-side in articulated fashion, the link comprising:

a substantially cylindrical body formed as a plastics molding and adapted to receive a soft projectile therein;

a soft projectile releasably held in the body;

a first hinge component formed integrally with the body and extending laterally from the body and comprising a hinge boss having a pair of hinge pins; and a second hinge component formed integrally with the body and extending laterally from the body at a position substantially opposite the first hinge component and comprising a pair of hinge lugs mutually spaced apart sufficiently to receive a hinge boss of an adjacent said link in the chain, each of the lugs having a recess adapted to pivotally receive a hinge pin of an adjacent said link in the chain, and wherein at least one of the hinge lugs comprises a cutout in a lug sidewall extending from the recess to enable lateral insertion of a hinge pin of an adjacent said link in the chain so that said hinge pin is snapped through the cutout into the recess.

2. The link of claim 1, wherein the body has open ends and the body comprises a through-passage extending between said open ends, the through-passage being wider at one open end than the other open end.

3. A toy ammunition chain made up of a plurality of the links of claim 1 hinged together side-by-side in articulated fashion.

4. In combination with the toy ammunition chain of claim 3, a toy gun comprising an advancing sprocket having teeth shaped to engage with each of the links of the chain for drawing each of the links into a firing position.

5. A toy ammunition chain made up of a plurality of the links of claim 2 hinged together side-by-side in articulated fashion.

* * * * *